United States Patent [19]

Scully

[11] 4,101,000

[45] Jul. 18, 1978

[54] EASY ACCESS OIL FILTER DRAIN SYSTEM

[75] Inventor: Andrew J. Scully, Mt. Clemens, Mich.

[73] Assignee: The United States of America as represented by the Secretary of the Army, Washington, D.C.

[21] Appl. No.: 815,882

[22] Filed: Jul. 15, 1977

[51] Int. Cl.[2] ..... F01M 11/04

[52] U.S. Cl. ..... 184/1.5

[58] Field of Search ..... 184/1.5, 106; 251/144; 137/351

[56] References Cited

U.S. PATENT DOCUMENTS

| | | | |
|---|---|---|---|
| 3,097,663 | 7/1963 | Buchwald | 184/1.5 X |
| 3,720,287 | 3/1973 | Martel | 184/1.5 |
| 3,908,797 | 9/1975 | Schnepp | 184/1.5 |
| 3,967,697 | 7/1976 | Guenther | 184/1.5 |

FOREIGN PATENT DOCUMENTS

| | | | |
|---|---|---|---|
| 10,128-72 | 12/1969 | Japan | 184/1.5 |

*Primary Examiner*—David H. Brown

*Attorney, Agent, or Firm*—Peter A. Taucher; John E. McRae; Nathan Edelberg

[57] ABSTRACT

Mechanism for draining an engine oil filter cartridge when the space beneath the cartride is otherwise obstructed. A special housing is threadably connected to the filter base in a non-obstructed location. A drain plug within this housing is manually unthreaded during a drain operation. A special boot in the mouth opening of the housing permits external actuation of the plug without undesired splash-out of oil through the mouth opening.

5 Claims, 3 Drawing Figures

EASY ACCESS OIL FILTER DRAIN SYSTEM

BACKGROUND AND SUMMARY OF THE INVENTION

In certain engines for military trucks the oil filters are positioned in an upstanding orientation alongside the engine block; the filter units are mounted on subjacent hollow bases that are bolted onto the engine. Each filter unit contains a considerable quantity of oil. There is therefore a danger that if the oil filter units are loosened and removed from the mounting bases without first draining the oil, then oil within the filter units will gush downwardly out of the filter units as they are lifted from the mounting bases.

To avoid this danger it has been proposed to provide a drain opening in the bottom surface of the filter base. However, in some engine installations the zone immediately beneath the filter base is obstructed by mechanisms such as valves, liquid lines, electrical lines, etc. In such cases it is impossible to position a container or funnel to collect the oil, resulting in oil splashing and spilling.

The present invention proposes an arrangement comprising a small auxiliary housing threaded into an opening in the exposed front wall of the filter base. A threaded plug is screwed into a passage in this small housing by means of a hex key wrench (Allen type) insertable through a mouth opening in the housing front wall. With this arrangement the sealing plug for the drain opening is easily accessible without having to put a wrench or funnel into the cluttered area beneath the filter base.

During a drain operation with the proposed structure the oil initially flows into the auxiliary housing in a horizontal direction; however it does not gush out through the aforementioned mouth opening because I provide a flexible boot over the mouth opening. The boot has a small hole therethrough which accommodates the hex key wrench; the boot is substantially sealed at the hole-wrench joint, and the oil is directed into a tubular downspout carried by the housing. A flexible hose can be telescoped onto the downspout to direct the oil to a nonobstructed zone for collection of disposal.

The invention is believed to provide several advantages, for examply easy access to the valve element for drain purposes, isolation of the valve element from inadvertent manual opening by technicians performing non-related maintenance operations, satisfactory sealing action when the engine is operating, relatively small space requirements over and beyond those of conventional drain plugs, relatively low manufacturing cost, and minimum modification of the existing engine structure.

The invention described herein may be manufactured, used, and licensed by or for the Government for governmental purposes without payment to me of any royalty thereon.

THE DRAWINGS

Figure 1:
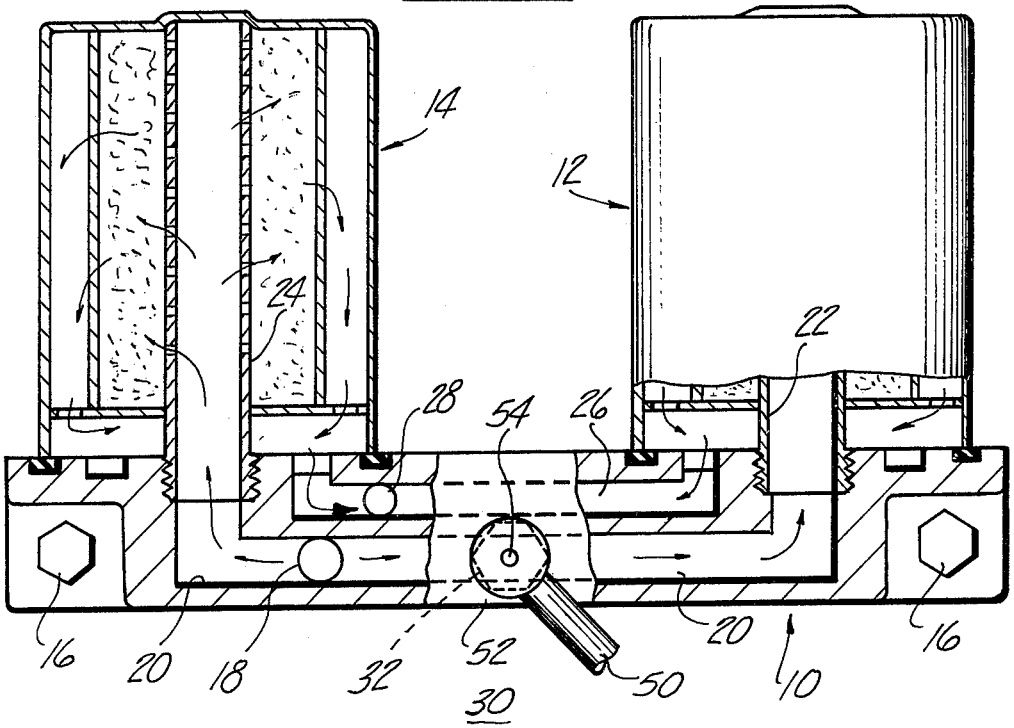
FIG. 1 is an elevational view of a base-oil filter assembly utilizing this invention, parts thereof being sectioned to show innerpassage detail.

The mechanism shown in FIG. 1 comprises a filter base 10 oriented beneath two filter cartridges 12 and 14. The illustrated mechanism would in practice be bolted onto the side of an engine block (not shown) by means of bolts 16. Thus FIG. 1 should be visualized as a view looking at the side of the engine, with the filter cartridges 12 and 14 projecting vertically upwardly from the hollow ledge-like base 10.

In the FIG. 1 arrangement oil is pumped from a passage in the engine block outwardly through a port 18 into a passage 20 within base 10. Part of the oil flows from port 18 in a rightward direction and thence upwardly through a tube 22 within filter cartridge 12. The remaining part of the oil from port 18 flows to the left and then upwardly through a supply tube 24 in filter cartridge 14. The oil exits from the filter cartridges into a passage 26 within base 10, as indicated by the directional arrows in the drawing. The oil eventually is discharged through a port 28 leading to the engine or to an oil cooler, not shown. The drawings are semi-schematic in nature; certain structural details and passage directions used in actual engine are omitted from the present drawing.

The location of the cartridges 12 and 14 above the hollow base 10 would tend to an undesirable splashing condition during a normal oil drain maintenance unless the cartridges were first drained of oil. Thus, if the cartridge 12 or 14 is rotated to unscrew the respective supply tube 22 or 24 from base 10 the oil within the respective cartridge is apt to splash in every conceivable direction as the supply tube threads out of the base. This splashing condition could be avoided by providing a drain opening on the underside of base 10. However in the engine, as installed in the truck, zone 30 beneath base 10 is obstructed by various mechanisms; therefore it is not feasible to attempt to provide a drain opening (and plug) on the undersurface of base 10. Instead, it is herein proposed to mount an auxiliary housing 32 in the space in front of base 10. The detailed construction of housing 32 is better shown in FIGS. 2 and 3.

Housing 32 is provided with a horizontal tubular extension 34 that is externally threaded to mesh with the threaded surface of a passage 36 extending from the front surface of housing 10 to the previously mentioned passage 20. Extension 34 defines a horizontal passage 38 whose front portion is threaded to receive a threaded plug 40. During normal operation of the engine plug 40 is threaded tightly into passage 38 to prevent flow of oil from the filter base 10. When it is desired to drain the oil from filter cartridges 12 and 14 plug 40 is unthreaded from passage 38, as by means of an allen wrench 42 (FIG. 3) or similar turning element. The allen wrench is inserted into a hexagonal socket 44 in the front face of plug 40 to permit manual rotation and unthreading of the plug. As the plug is drawn outwardly to the FIG. 3 position oil flows from passage 38 into the main cavity 46 in housing 32, thence downwardly through a tubular downspout 48 suitably affixed to the housing. A flexible hose 50 may be telescoped onto downspout 48 to lead the oil away from obstructed areas of the engine.

Figure 2:
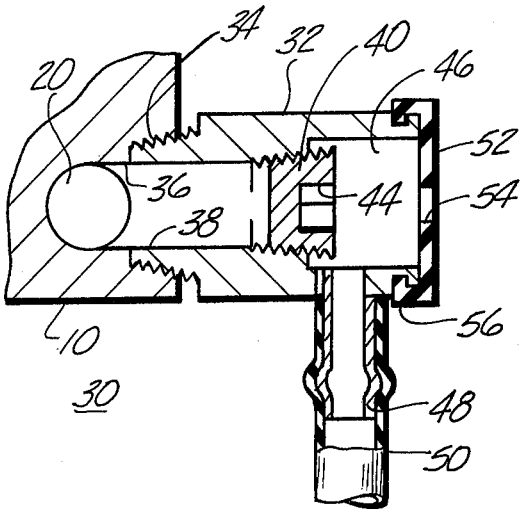
FIGS. 2 and 3 are sectional views through an auxiliary housing used in the FIG. 1 assembly, FIG. 2 being taken when the unit is sealed (engine running), and FIG. 3 being taken during an oil draining operation.
Figure 3:
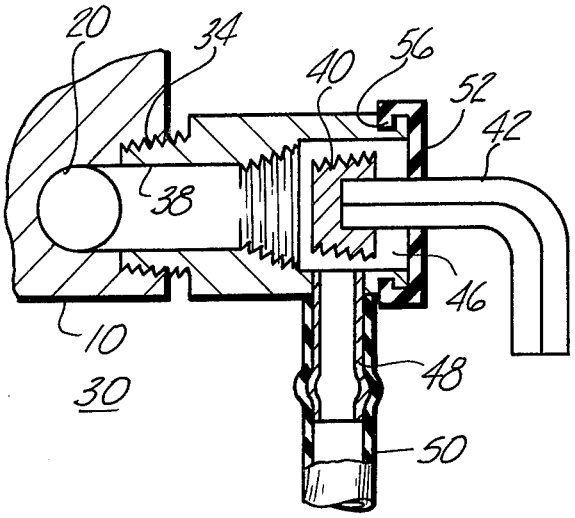

When the plug 40 is initially separated from passage 38 the oil is apt to pour outwardly through the mouth opening defined at the front of cavity 46. To prevent this from occuring there is provided over the opening a flexible front cover or boot 52. As shown in FIG. 2, the boot is formed with a small hole 54 aligned with the socket 44 in plug 40. This hole is a circular hole having a diameter approximately the same as the diameter of socket 44 measured between the flat surfaces of the hexagon. Therefore the turning element 42 can be inserted through the hole 54 into socket 44 and turned around the socket axis without opening a significant leakage path at the joint formed by the hole 54; the edge of the hole substantially seals against the surface of the allen wrench.

Front cover 52 is detachably connected to housing 32 to permit initial assembly of plug 40 into cavity 46, and also to permit plug 40 to be completely removed from housing 32 if it becomes necessary to inspect the plug or replace it with another plug. The removable mounting of the cover can be achieved by forming the cover or boot with an inturned peripheral flange 56, and seating the flange in a peripheral groove on the external surface of housing 32.

Housing 32 is initially installed on filter base 10 by merely screwing the tubular extension 34 into the threaded passage 36. This is facilitated by manufacturing the housing with external wrench flats, as shown in FIG. 1.

The drawings show one specific embodiment of the invention, but it will be appreciated that minor variations or changes may be made without departing from the inventive concept as outlined in the appended claims.

I claim:

1. In an engine having an oil filter base bolted to an engine side surface such that the zone immediately beneath the base is obstructed: improved mechanism for draining oil from the base, comprising an auxiliary housing having a horizontal tubular extension threaded into an opening in the exposed side surface of the filter base so that oil within the base can drain outwardly through the horizontal passage formed by said extension; said horizontal passage being internally threaded in the end thereof leading into the housing; a threaded plug normally seated in the threaded portion of the passage to prevent flow of oil from the filter base through the passage; said housing including a frontal mouth opening larger than the diameter of the plug, whereby the plug can be inserted through the mouth opening and thence into the threaded portion of the passage; a flexible front cover connected to the housing for preventing escape of oil through the mouth opening when the plug is unthreaded from the passage; said front cover having a relatively small hole therethrough aligned with the passage axis, whereby a turning implement can be inserted through the hole to rotate the plug without removing the cover; said housing having an external tubular downspout for gravitational discharge of oil from the housing.

2. The mechanism of claim 1: the plug having a hexagonal socket in the surface thereof that faces the front cover; the hole in the front cover being a circular hole having a diameter approximately the same as the diameter of the socket measured between the flat surfaces of the hexagon, whereby a hexagonal turning element can be inserted into the socket and rotated without opening a significant leakage path through the joint at the hole and turning element.

3. The mechanism of claim 1: the improvement further comprising a flexible drain hose having one end thereof telescoped onto the tubular downspout for leading the oil away from obstructed zones adjacent the engine.

4. The mechanism of claim 1: said housing having external wrench flats centered on a horizontal axis defined by the tubular extension, whereby the housing can be mounted on the filter base by applying wrench force to the housing.

5. The mechanism of claim 1: the flexible front cover comprising an elastomeric boot having an inturned peripheral flange engaged in a peripheral groove on the external surface of the housing.

* * * * *